United States Patent [19]

Freed

[11] Patent Number: 4,603,326

[45] Date of Patent: Jul. 29, 1986

[54] ANTI-THEFT DETECTOR RESPONSIVE TO A CHEMICAL AGENT

[75] Inventor: Donald J. Freed, Needham, Mass.

[73] Assignee: ICI Americas Inc., Wilmington, Del.

[21] Appl. No.: 650,276

[22] Filed: Sep. 14, 1984

[51] Int. Cl.[4] ..... G08B 13/14

[52] U.S. Cl. ..... 340/572; 283/95; 340/632

[58] Field of Search ..... 340/572, 632; 116/214; 73/23; 109/25, 29, 31, 39; 283/95

[56] References Cited

U.S. PATENT DOCUMENTS

| | | | |
|---|---|---|---|
| 2,203,675 | 6/1940 | Davis | 109/39 |
| 3,272,533 | 9/1966 | Allen . | |
| 3,507,229 | 4/1970 | MacDonald | 109/29 |
| 3,718,113 | 2/1973 | Schertler et al. | 116/214 |
| 3,725,895 | 4/1973 | Haynes | 73/23 X |
| 4,045,997 | 9/1977 | Showalter et al. | 340/632 X |

FOREIGN PATENT DOCUMENTS

| | | | |
|---|---|---|---|
| 2243198 | 3/1974 | Fed. Rep. of Germany | 109/29 |

*Primary Examiner*—James L. Rowland
*Assistant Examiner*—Brian R. Tumm

[57] ABSTRACT

Anti-theft device, tag assembly and article theft detection system. An anti-theft device having a thin elongated sealed container (e.g., a closed tube) containing a chemical agent is attached to each article to be protected. One or more detectors capable of detecting the chemical agent are placed in the area to be protected. Removal of the anti-theft device, which requires cutting or tearing, causes the chemical agent to be released and to be detected by a detector. This in turn registers an alarm. The anti-theft device may be combined with a tag to form a tag assembly. The tag may contain a passive transponder of a type used in electronic article surveillance systems. A transmitter and receiver placed near the exit from the protected area will cause an alarm to be activated if someone attempts to remove a protected article with tag attached from the protected area.

5 Claims, 7 Drawing Figures

ANTI-THEFT DETECTOR RESPONSIVE TO A CHEMICAL AGENT

BACKGROUND OF THE INVENTION

1. Field of the Invention

This invention relates to anti-theft devices and systems for protecting articles against pilferage. More particularly, this invention relates to anti-theft devices which contain a detectable chemical agent and to systems which are capable of detecting that chemical agent.

2. Description of the Prior Art

Flexible plastic fasteners for attaching a sales tag to an article are well known. A brochure entitled "Swiftach TM Systems for tag attaching," published by Dennison Manufacturing Company, Framingham, Mass., 1977, illustrates several such fasteners. The fasteners are nonreusable and must be cut or broken before they can be removed. These fasteners "offer maximum security against 'would be ticket switchers'", according to the brochure. However, these fasteners do not prevent a dishonest customer or employee from removing the tag from the article unobserved (as for example in a dressing room) and leaving the store with the article.

Various types of systems for detecting unauthorized removal of an article from a protected area are also known. Such systems monitor the passage of a protected article through the exit doorway of a protected area such as a store. One such type of system (probably the type enjoying the greatest commercial acceptance at present) comprises a radio transmitter and receiver typically located near the exit (or exits) from the protected area, and a "passive" device or tag attached to each article to be protected. When a shoplifter attempts to take a tagged article through a protected exit, the tag receives a signal from the transmitter and reradiates a signal of a frequency different from the transmitter frequency. The receiver picks up the reradiated signal and causes an alarm to sound. Representative systems of this type are described in Welsh et al. U.S. Pat. No. 4,063,229 and in the copending commonly assigned application of Harold B. Williams, Ser. No. 373,251, filed Apr. 29, 1982, now allowed.

Theft detection systems employing chemical agents have been described in only a few references and such systems have not gained commercial acceptance. One such system, used for monitoring exits, is described in Haynes U.S. Pat. No. 3,725,895. In this system, the article to be protected is sprayed with an aerosol spray which contains a detectable chemical agent, e.g., a "Freon" compound microencapsulated in a polymer matrix. Presence of the chemical agent may be detected electronically, e.g., by a gas chromatograph equipped with an electron capture detector placed near a store exit. A second chemical agent, applied by a cashier at the time of sale, indicates that the article has been purchased. If the detector detects only the first chemical agent, indicating a theft, an alarm sounds.

Another device employing a chemical agent is shown in Allen U.S. Pat. No. 3,272,533. This device, which is described as being useful to indicate theft of paper money and other negotiable paper, comprises a brittle (glass or brittle plastic) tube containing a chemical agent having a distinctive odor. The tube is secured to a bill by an adhesive. Breakage of the tube (either intentionally by a teller or unintentionally by a thief) during handling of the money releases the chemical agent. The agent may be detected by human or canine sense of smell. A disadvantage of this is that the tube may be broken unintentionally in normal handling.

Systems for protecting exit doors give no protection against a thief who removes the tag from the protected article while still inside the store. One answer to this problem is the widespread use of tags having locks which require a special tool in order to remove the tag from the protected article. Such tags are expensive: also, they subject the customer to considerable inconvenience if (as sometimes happens) the sales clerk forgets to remove the tag at the time of sale. Also, such locks do not deter thefts by store employees to any appreciable extent, since many store employees have access to the special tools required to unlock the tags.

SUMMARY OF THE INVENTION

The present invention provides an anti-theft device for attachment to an article to be protected, which device comprises a thin elongated sealed container for a chemical agent, and a gaseous or volatile liquid chemical agent in said container. The container is essentially unbreakable but capable of being cut. The anti-theft device also include means for attaching the device to a protected article in such manner that it cannot be removed without rupturing the container. The chemical agent is capable of detection when released. The preferred container is a flexible tube.

The chemical agent is a material which can be reliably detected when present in air in small concentrations. Means known in the art, such as optical means (e.g., either ultraviolet or infra-red) may be used for detection.

The present invention further provides a system for theft detection which comprises the aforesaid anti-theft device and a detector for detecting the presence of the chemical agent. The system may also include an alarm or other device which is actuated by the detector.

A preferred embodiment of the invention is a tag assembly comprising the combination of a thin, essentially flat tag and the anti-theft device described above. The anti-theft device is associated with the tag in such manner that the two cannot be separated without rupturing the container of the anti-theft device.

The tag in an especially preferred embodiment of the invention includes a passive transponder so that the tag assembly may be used either to indicate removal of the tag assembly inside a store or unauthorized taking of a protected article through the store exit.

In operation, an anti-theft device is attached to each article to be protected. Normally this device will remain attached until the article is sold and removed from the protected area, (i.e., the area within operational range of the detector). However, if a thief (e.g., shoplifter or dishonest employee) attempts to remove the device from the article while the article is still within the protected area, he (or she) will usually find it necessary to cut the device, releasing the chemical agent, which will be detected by the detector.

DESCRIPTION OF THE PREFERRED EMBODIMENTS

Figure 1:
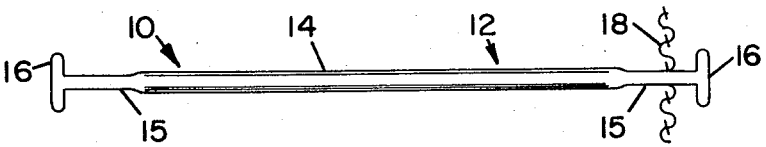
FIG. 1 is a front elevational view of an anti-theft device according to one embodiment of this invention.

FIG. 1 shows an anti-theft device 10 according to one embodiment of the invention. The anti-theft device of this embodiment is particularly suitable for attachment to articles of clothing.

As shown in FIG. 1, the anti-theft device 10 is in the form of a thin elongated sealed container which contains a volatile chemical agent which can be detected when released. Anti-theft device or container 10 has an elongated tubular body 12 which comprises a hollow central portion 14 of larger diameter and two hollow end portions 15 of smaller diameter, and a pair of laterally extending hollow end pieces 16 which extend from either end of tubular body 12. The central portion 14 and the two end portions 15 of body 12 are axially aligned and are joined by tapered sections (unnumbered). The end portions 15 provide means for attaching the anti-theft device 10 to an article to be protected. The end portions 15 may be of smaller diameter than the central portion 14. Tubular body 12 must be large enough in diameter to hold an effective amount of chemical agent, but is preferably no larger than necessary for that purpose. Central portion 14 may have an inside diameter of up to about 1, preferably not over about 0.5 mm., while the end portions 15 are of smaller diameter, e.g., about the same diameter as nylon ties presently used to affix tags to garments.

An anti-theft device 10 can be attached to a protected article 18, such as an article of clothing, by passing one end piece 16 and the adjacent end portion of tubular body 12 through the protected article. After the anti-theft device 10 has been secured to a protected article 18 in this manner (i.e., as shown in FIG. 1), it cannot be removed without cutting the anti-theft device and releasing the chemical agent. Since the entire device, including the end pieces, is hollow, cutting anywhere will release the chemical agent.

A container for the chemical agent is used because the volume of chemical agent released from a container is much larger than that which would be released from microcapsules, as shown for example in U.S. Pat. No. 3,725,895. This improves reliability of detection.

Anti-theft device 10 is made of a material which is essentially nonbreakable but which is capable of being cut with ordinary scissors. The material may be either flexible or rigid, although flexible materials are preferred. Nylon is the preferred material although other thermoplastics can be used. The material should be sealable and should have low permeability (ideally it should be impermeable) to the chemical agent in either liquid or vapor form. Also, the container 10 should be able to withstand moderate superatmospheric pressures, since the chemical agent may be a gas under pressure or a liquid which boils at temperatures below ambient at atmospheric pressure. Plastics and in particular nylon can withstand higher pressures than thin walled glass.

Container 10 is preferably tubular. However, container 10 may have cross sectional shapes other than circular, provided it is thin and elongated. The container may be shaped like an envelope, for example.

The chemical agent is a gaseous or volatile liquid material which can be detected by suitable means (e.g., an instrument) when present in air in small concentrations. The chemical agent should also be non-toxic at the concentrations in which the agent will be present in air when released from container 12. The chemical agent should also be odorless or have an inoffensive odor. BCF (bromochlorodifluoromethane, B.P. 4° C.) is preferred. Surprisingly BCF stays within a nylon container although volatile materials generally diffuse through thermoplastics. Other compounds having a boiling point not above about 60° C., preferably from about −20° C. to about +30° C., at atmospheric pressure, and particularly other fluorine-containing halohydrocarbons, can be used as chemical agents. Gases and volatile liquids are used so that the material will be released quickly and completely when container 10 is cut. The chemical agent is at a pressure which is determined by its vapor pressure at ambient temperature.

Container 10 may be formed by conventional techniques such as injection molding. The container 10 as formed has an opening (say at the junction of body 12 with an end piece 16) to permit filling with the chemical agent. This opening may be closed by known techniques, such as ultrasonic welding or heat sealing, after the container is filled. The container 10 is preferably chilled except in the vicinity of the opening during filling and closing in order to facilitate filling and minimize loss of chemical agent.

Figure 3:
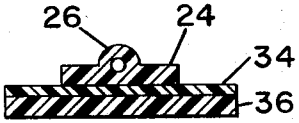
FIG. 3 is a sectional view, taken along line 3—3 of FIG. 2.
Figure 2:
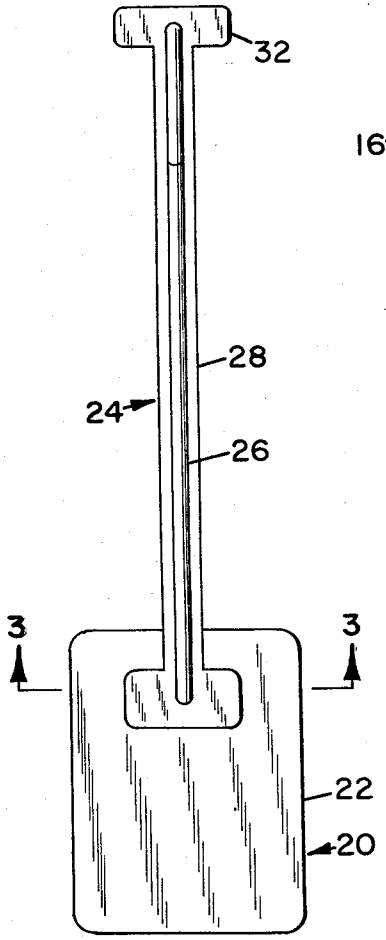
FIG. 2 is a front elevational view of a tag assembly according to this invention.

FIGS. 2 and 3 illustrate an anti-theft device according to a second embodiment of the invention. The anti-theft device of this embodiment is a tag assembly 20 which comprises, in combination, a thin, essentially flat tag 22 and an anti-theft device 24 which includes thin elongated sealed container 26. The anti-theft device 24 is associated with the tag 22 in such manner that the two cannot be separated without rupturing the container 26. The anti-theft device 24 according to this embodiment is a one-piece member 24 of molded plastic (preferably flexible) or other cuttable but essentially unbreakable material (e.g., nylon), which is shaped so as to form a sealed tubular container 26 containing a chemical agent (shown here as a liquid) which is detectable when released, and a thin flat rectangular strip or web 28 which is wider and slightly longer than the tubular container 26. The member 24 has two laterally extending tabs 30 and 32, one at each end.

One-piece member 24 is joined to tag 22 by conventional means, such as heat sealing or adhesive, via tab 30. When so joined, the one-piece member 24 and the tag 22 cannot be separated without rupturing container 26.

Tag 22 may be suitable for receiving written or printed indicia, such as price, size, etc. Tag 22 as shown (FIG. 3) has two plastic layers 34 and 36 laminated together. Alternatively tag 22 may be a laminate comprising a card stock (paper) layer and a plastic layer, or a laminate comprising a card stock inner layer and two plastic layers, one on either side of the card stock layer.

In another alternative, tag 22 may be a thin plastic member which includes a passive transponder, as will be described with reference to FIG. 5.

The tag assembly 20 is a small light weight unit which can be readily attached to an article to be protected. Tag assembly 20 is particularly suitable for attachment to articles of clothing and to articles having handles. For example, to attach tag assembly 20 to a coat or jacket having buttonholes, tab 32 and a portion of the one-piece member 24 are passed through a buttonhole, the device is bent until tabs 32 touch tag 22 and the tab 32 is secured (e.g., by adhesive or heat sealing) to tag 22, preferably near tab 30. Once this is done, tag assembly 20 cannot be removed from the protected article without cutting tubular container 26 and releasing the chemical agent.

Typical dimensions of member 24 are as follows: length, 15 cm (about 6 inches): width of strip 28, about 1 to 2 mm: internal diameter of tube 26, about 0.05 to about 0.5 mm (about 50 to about 500 microns). Member 24 and tube 26 may be larger or smaller as desired.

Member 24 may be formed by conventional techniques such as injection molding. Container 26 in member 24 as formed is open at one end, in order to permit charging of the chemical agent. The open end of container 26 may be heat sealed after the chemical agent has been charged.

One-piece member 24 may be used by itself (i.e., without tag 22) as an anti-theft device if desired. When so used, one of the tabs 30 or 32 may be looped through a buttonhole or around a handle of a protected article and fastened to the other tab 32 or 30.

Figure 4:
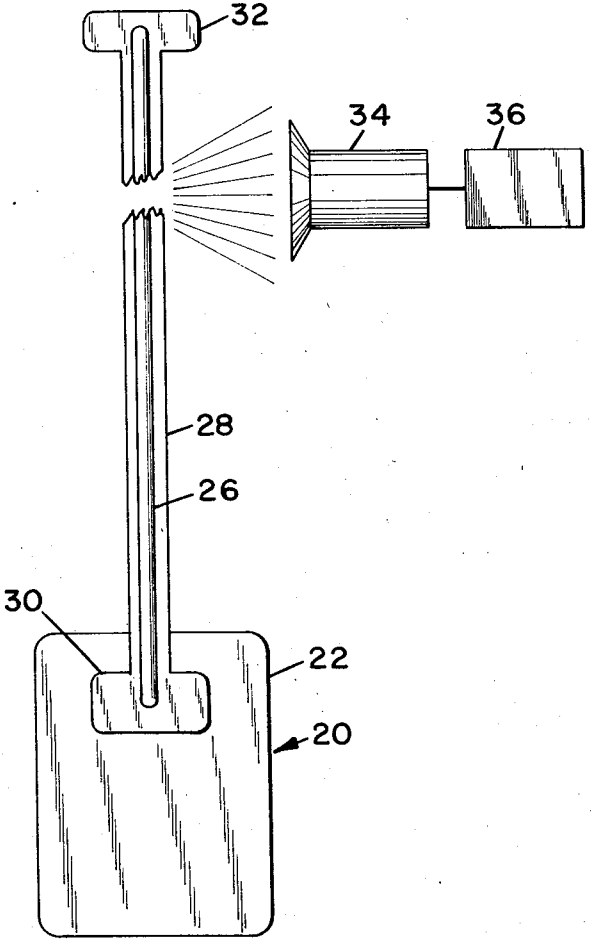
FIG. 4 is a schematic view of the security system of this invention, showing the tag assembly of FIG. 2 after it has been cut.

FIG. 4 illustrates schematically a system for detecting the presence of a chemical agent. The system includes a detector 34 which is capable of detecting the presence of the chemical agent used in the anti-theft device 10 or 20, and an alarm 36 which is actuated by the detector 34. The detector may be of any known type for detection of specific gases and vapors in minute concentrations, as for example a photoionization detector or an infra-red spectrometer which is tuned to the wavelength characteristic of the chemical agent.

Figure 5:
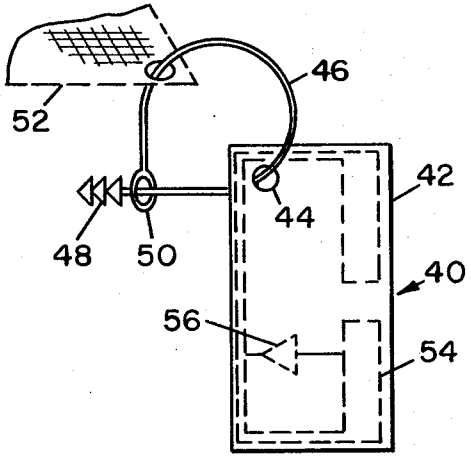
FIG. 5 is a front elevational view of a modified form of tag assembly.

FIG. 5 illustrates a tag assembly according to another embodiment of the invention. The anti-theft device of this embodiment is particularly useful for attachment to clothing. In FIG. 5, 40 is a tag assembly comprising, in combination, a thin, essentially flat tag 42 having an eyelet 44 near one corner thereof, and an anti-theft device in the form of a flexible tubular loop tie 46 which forms a sealed container for the chemical agent. Loop tie 46 has a one-way fastener 48 at one end and an eyelet 50 at the other end. Tag 42 may be secured to a protected article 52, e.g., an article of clothing (only a portion of which is shown in FIG. 5) by passing the one-way fastener 48 successively through the protected article 52, eyelet 44 of tag 42, and eyelet 50 of loop tie 46. The one-way fastener 48 is such that it cannot be pulled backwards through eyelet 50. One way fastener 48 and eyelet 50 together provide means for attaching loop tie 46 to protected article 52 so that the loop tie cannot be removed without being ruptured. If one wishes to remove tag 42 from protected article 52, it is necessary to cut the loop tie 46, releasing the chemical agent.

Tag 42 preferably contains a passive transponder, shown as a dipole antenna loop 54 and diode 56. The antenna and diode may be similar to those shown and described in copending commonly assigned application of Harold B. Williams cited supra. The antenna loop 54 is broadly tuned to a predetermined transmitter frequency (say 915 MHz), and reradiates a signal of a different frequency (say a second harmonic) when it receives a signal having a frequency close to the predetermined frequency. A transmitter (or transmitters), a receiver and an alarm of a type used in known electronic article surveillance systems as described for example in the aforesaid Williams application or in U.S. Pat. No. 4,063,229 cited supra, may be placed near the exit from the protected area. The anti-theft device shown in FIG. 5 thus provides protection against both removal of the tag within the protected area and taking of a tagged article from the protected area. The chemical agent detection system will sound an alarm if the tag is removed from the article inside the protected area. If a person attempts to take an article with an intact tag thereon out of the protected area, the electronic system causes an alarm to be sounded.

Figure 6:
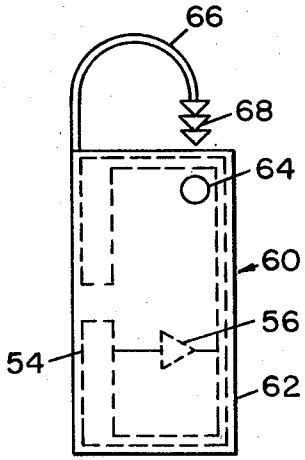
FIG. 6 is a front elevational view of another modified form of tag assembly.

FIG. 6 illustrates a tag assembly according to still another embodiment of the invention. Referring to FIG. 6, the tag assembly 60 of this embodiment comprises a tag 62 having an eyelet 64, and a flexible tubular plastic (e.g., nylon) tie 66 which is fastened to tag 62 at one end and which has a one-way fastener 68 at the other end. Plastic tie 66 constitutes the anti-theft device of this embodiment. Plastic tie 66 forms a container for a chemical agent, which may be as previously described. A reservoir for chemical agent in communication with the interior of plastic tie 66 may be formed on tag 62 as shown in order to increase the amount of chemical agent the tag assembly can carry. Also, tag 62 may include a passive transponder as shown in FIG. 5. The tag 62 may be fastened to a protected article (not shown) by passing one-way fastener 68 first through the protected article and then through eyelet 64. Once this has been done, the tag cannot be removed without cutting the tie 66 and releasing the chemical agent.

Whether the container for chemical agent is joined to the tag as in FIGS. 2 and 6, or is a separate piece as in FIG. 5, the container is associated with the tag in such manner that the two cannot be separated without rupturing the container. The tag assemblies of FIGS. 5 and 6 may be formed, and their respective containers (or reservoir) filled with chemical agent and closed by means known in the art.

The various means for attaching an anti-theft device of this invention to a protected article are merely illustrative. Other arrangements for attaching the anti-theft device so that it cannot be removed from the protected article without cutting the container may be used.

Figure 7:
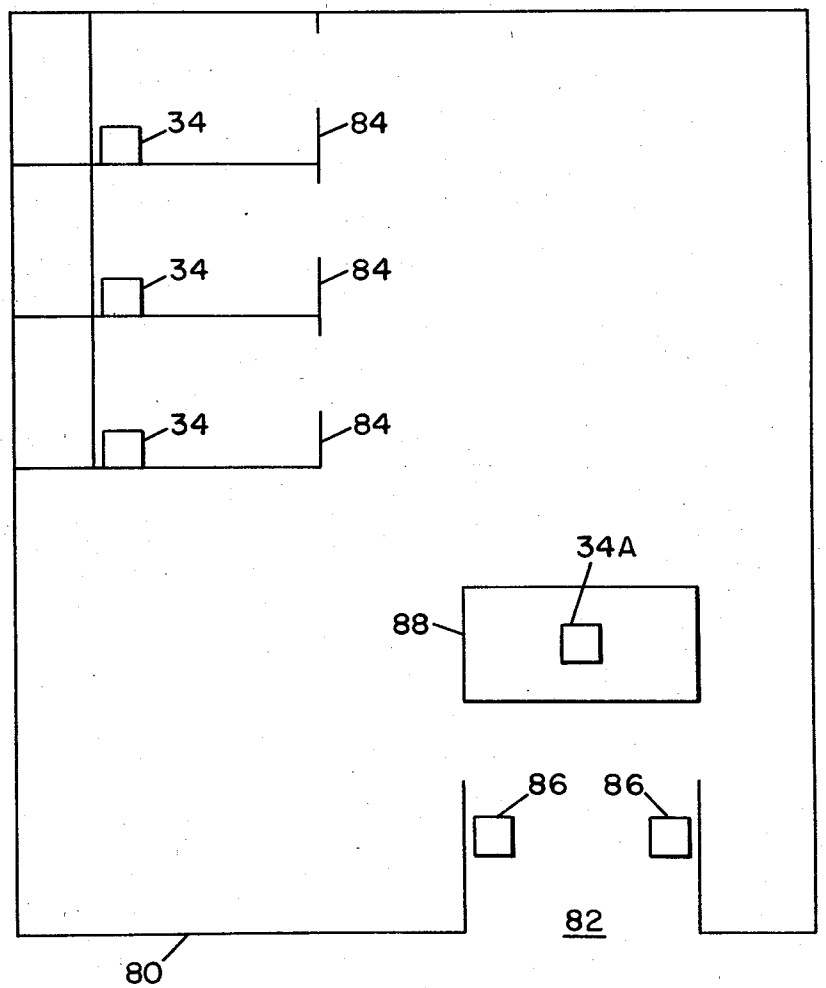
FIG. 7 is a plan view of a theft detection system according to this invention which includes both a detector (or detectors) for indicating the presence of a chemical agent and a transmitter and receiver at the exit doorway to indicate unauthorized taking of a protected article through the exit.

FIG. 7 illustrates a system for protecting articles either from removal of a tag within a protected area or from unauthorized removal of a protected article from the protected area. This system uses a tag assembly, such as that shown in FIG. 5 which includes both a chemical agent and a passive transponder. Referring to FIG. 7, 80 denotes a protected area, such as a store or a department within a store, which has an exit 82 and one or more dressing rooms 84. Detectors 34 for the chemical agent are placed at desired locations within the protected area, for example, in dressing rooms 84. It is particularly desirable to place the detectors 34 in places within the protected area that are not easily observed visually, such as dressing rooms or rest rooms. Detectors placed in dressing rooms will generally be closer to the point where tag removal is likely to take place than is the case in the rest of the protected area. This increases their reliability. Additional detectors (not shown) may be placed at other locations within the protected area, such as near the ceiling above the sales floor, if desired. An alarm indicator (not shown) may have means for indicating which detector has been activated by the chemical agent, so that store personnel can pinpoint just where a tag has been removed.

The exit doorway 82 has one or more transmitters and a receiver, which may be electronic article surveillance system components of known type (e.g., as described in the aforesaid Williams application or in U.S. Pat. No. 4,063,229). The transmitter(s) and receiver may be housed in pedestals 86 on either side of exit doorway 82, as is conventional in electronic article surveillance system installations. Detectors 34 and the receiver near exit 82 are connected to an alarm or alarms (not shown in FIG. 7), which may be placed in any desired location (e.g., either in the store manager's office or near the detector or receiver). The alarm or alarms (collectively "alarm means") are responsive to the detector(s) and receiver.

When someone removes a tag while in the protected area (particularly while in a dressing room), he (or she) must cut the container for chemical agent. One or more of the detectors 34 will detect the chemical agent, activating an alarm. Air currents within the protected area may cause some drift of the chemical agent, so that more than one detector 34 may detect the chemical agent and generate an output signal. However, one of the detectors (usually the one nearest the point of unauthorized tag removal) will usually receive a higher concentration of chemical agent than the others and generate a stronger output signal, so that the approximate location of unauthorized tag removal may be pinpointed.

If someone attempts to take a protected article with the tag still attached, the transponder will receive a transmitter signal and reradiate a signal of different frequency to the receiver, activating an alarm (not shown).

When an article is purchased (e.g., at cashier's desk 88), the sales clerk removes the anti-theft device, e.g., by cutting the container for chemical agent. The alarm system may be prevented from sounding or displaying an alarm in such instance. This may be accomplished by various means, as for example by placing a detector 34A near the desk 88 and providing alarm circuitry such that the alarm will not function when this detector 34A receives a higher concentration of chemical agent (indicating that the container was cut at the cashier's desk rather than at an unauthorized location) than any of the other detectors 34 within the protected area 80.

What is claimed is:

1. A tag assembly for attachment to an article to be protected, said tag assembly comprising, in combination (I) a thin, essentially flat tag, said (II) an anti-theft device comprising:

(a) a thin elongated sealed container for a chemical agent, said container being essentially non-breakable but capable of being cut;

(b) a volatile chemical agent in said container, said chemical agent being a gas, a volatile liquid or a mixture thereof which is capable of detection when released; and (c) means for attaching said device to a protected article in such manner that the device cannot be readily removed without rupturing the container;

wherein said anti-thift device is associated with said tag in such manner than the two cannot be separated without rupturing the container of said anti-theft device.

2. A tag assembly according to claim 1 in which said container is flexible.

3. A tag assembly according to claim 1 in which said container is tubular.

4. A tag assembly according to claim 1 in which said tag contains passive transponder means for receiving and reradiating electromagnetic radiation.

5. A theft detection system comprising:

(a) a tag assembly according to claim 4, (b) a detector for indicating the presence of said chemical agent, (c) a receiver for receiving a reradiated signal from said transponder means, and (d) alarm means responsive to said detector and said receiver.

* * * * *